United States Patent [19]

Schmidt

[11] 4,394,792

[45] Jul. 26, 1983

[54] BUCKLE FOR A SAFETY BELT

[75] Inventor: Yves Schmidt, Audincourt, France

[73] Assignee: Aciers et Outillage Peugeot, Audincourt, France

[21] Appl. No.: 263,249

[22] Filed: May 13, 1981

[30] Foreign Application Priority Data

May 14, 1980 [FR] France ..... 80 108277

[51] Int. Cl.[3] ..... A44B 11/25

[52] U.S. Cl. ..... 24/230 A

[58] Field of Search ..... 24/230 A, 230 AL

[56] References Cited

U.S. PATENT DOCUMENTS 4,182,008 1/1980 Pouget ..... 24/230 A

*Primary Examiner*—Hugh R. Chamblee

*Attorney, Agent, or Firm*—Sughrue, Mion, Zinn, Macpeak and Seas

[57] ABSTRACT

In this buckle, a stop device which locks a locking device in the closed configuration of the buckle is formed by a body in a single piece which has guiding and maintaining portions adapted to receive return springs for a buckle operating knob and the locking device. The stop device is advantageously made from a moulded plastics material having a fibre glass filler.

10 Claims, 7 Drawing Figures

BUCKLE FOR A SAFETY BELT

DESCRIPTION

The present invention relates to buckles for a safety belt employed in vehicles for retaining the passengers on their seat and protecting them in the event of accidents.

Such buckles usually comprise a tongue member or latch which is adapted to be attached to a portion of the belt whereas the buckle is attached to retaining means which may be another portion of the belt or fixing means (also termed peduncle) rigidly connected to the body of the vehicle.

In the prior art, buckles have already been designed which comprise a support which is adapted to be fixed to retaining means and defines a rectilinear passage in which the latch may be inserted and which defines a sliding point for the latter. Locking means for the latch are mounted on the support to pivot about an axis which extends parallel to the plane of the passage. These locking means may have a first abutment surface retaining the latch and extending in a direction perpendicular to the plane of the passage and transversely of the latter, in the locked position of the buckle, whereas the locking means may also have at least a second abutment surface which is adapted, in the locked position of the buckle, to come in contact with stop means mounted on the support to be movable in translation in a direction perpendicular to the pivot axis of the locking means. The displacement of the stop means releases the locking means, and consequently the latch, when the opening of the buckle is ensured by an operating knob which is mounted on the support to be movable in the same direction as the stop means. Return springs are provided for acting on the locking means, the stop means and the operating knob.

An object of the invention is to simplify the construction of such a buckle and to render the assembly thereof more easy.

According to the invention, there is provided a buckle of the type described hereinbefore, wherein the stop means comprise a body in a single piece having means for guiding and maintaining springs extending on each side of the body in opposite directions perpendicular to the pivot axis of the locking means.

Such an arrangement of the stop means enables various parts, which were heretofore separate, to be eliminated and markedly facilitates the assembly of the springs in the buckle in the course of manufacture.

According to another feature of the invention, said stop means are made from moulded plastics material preferably with a fibre glass filler.

Further features of the invention will be apparent from the ensuing description which is given solely by way of example with reference to the accompanying drawings in which.

Figure 1:
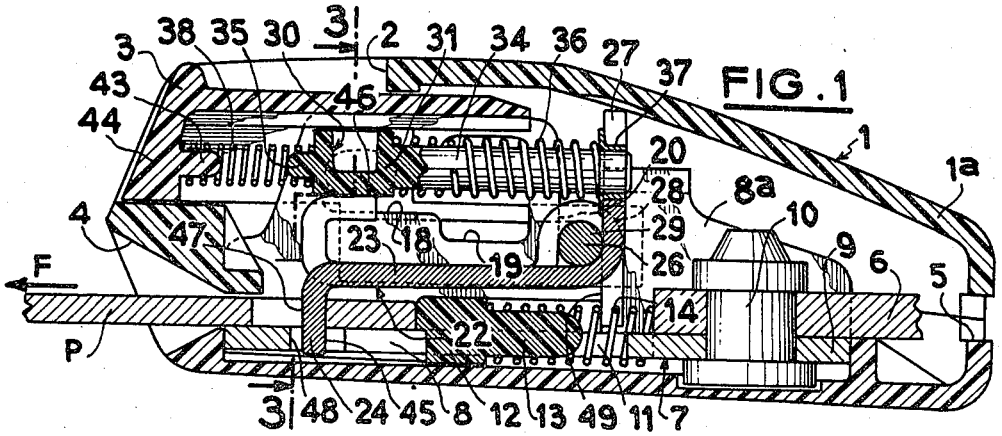
FIG. 1 is a sectional and elevational view of the buckle for a safety belt according to the invention, the buckle being shown in the closed position thereof.
Figure 2:
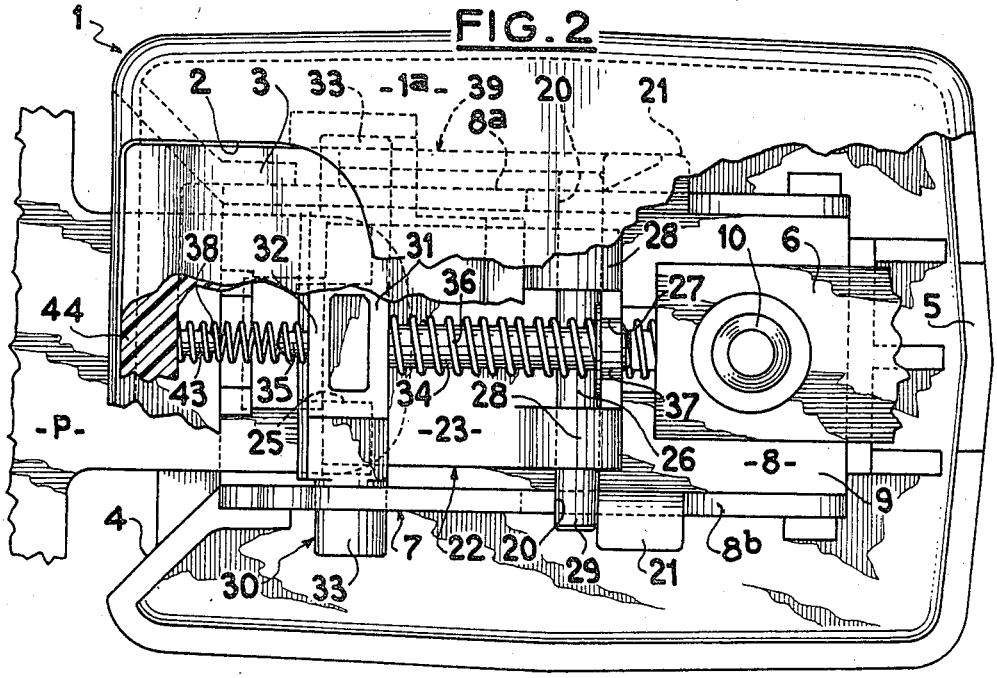
FIG. 2 is a plan view of the buckle with parts cut away so as to reveal the interior.

In the embodiment shown in the Figures, the buckle according to the invention comprises an outer case 1 having two parts 1*a* and 1*b* which are interconnected in a joint plane. As the case is made from a plastics material, the two parts are preferably interconnected by welding.

The upper part 1*a* has in the front thereof (on the left side of the Figures), an opening 2 in front of which an operating knob 3 is placed. The lower part 1*b* also has on the left an input opening 4 through which a latch P attached to a portion of a safety belt (not shown) may be inserted into the buckle. At the opposite end, i.e. at the rear, the case 1 has an aperture 5 for the passage of retaining means 6, here formed by a rigid plate which may be fixed to a fixed point of the body of a vehicle, such as for example a peduncle. It may also be connected to another portion of the safety belt. A support 7 of blanked and folded sheet metal is placed in the case 1. This support has a U-shaped and comprises a web 8 and two lateral branches 8*a*,8*b*, the rear portion 9 of the web 8 serving to fix the retaining means 6 to the support by means of a rivet 10.

The web 8 has a longitudinal aperture 11 in which is slidable the guiding portion 12 of a slide 13 which is longitudinally movable between the branches of the support 7 in opposition to the action of a spring 14, termed "ejection" spring for ejecting the latch when opening the buckle.

The slide 13 is slidably mounted in the bottom of the support 7 by means of projections 15 produced by a press operation in the branches 8*a* and 8*b* respectively and extending longitudinally. The front edge of the slide 13 is so shaped as to match the shape of the front edge of the latch P.

Each of the branches 8*a*, 8*b* of the support 7 has a front portion 16 of relatively great height in which an opening 17 is formed. This opening has two main parts 18 and 19 of distinct widths, the smallest width being located in the front part 18 of the opening. At the rear of the front portion 16 of each branch 8*a*, 8*b* there is formed a notch 20 having a rounded inner end and acting as a bearing. At the rear of this notch 20, the branch 8*a*, 8*b* has a retaining tab 21 which is folded at a right angle and extends laterally outwardly of the branch, the purpose of which tab will be clear hereinafter.

Locking means 22 are placed between the branches 8*a*, 8*b*. These means comprise a blanked and folded metal sheet and includes a generally rectangular main portion 23. The front edge of this intermediate portion has a tab 24 which is folded downwardly at a right angle and two bearing tabs 25 which are folded in the opposite direction and laterally outwardly project from the edge of the intermediate portion 23. The latter has at the rear thereof a median region 26 which is extended rearwardly and upwardly bent so as to define an eye member 27. Collars 28 are disposed on each side of the median region and are formed by tabs which are first bent upwardly and thereafter downwardly so as to fit round a pin 29 which is inserted in the collars 28 and maintained in the intermediate portion thereof by the median region 26 and the eye member 27. Preferably, upon assembly, this pin is slightly clamped so as to form a single piece with the locking means and thereby facilitate assembly. The pin is rotatively mounted in the bearings formed by the notches 20 in the respective branches 8*a* and 8*b* of the support 7.

Stop means 30 are disposed transversely in the support. These means comprise a single-piece body 31 preferably made from molded plastics material which advantageously has a fibre glass filler. The median portion 32 of this body 31 has a parallelepipedic shape and two slide portions 33 respectively extend on each side of this body and are engaged in the opening 17 formed in the branches 8*a*, 8*b* respectively. Guiding and maintaining means 34 and 35 project in the longitudinal direction of the support from the median portion 32 of the stop means 30. The rear guiding and maintaining means, which have a relatively great length, are surrounded by a return spring 36 which bears against a ring 37 engaged in the eye member 27 of the locking means 22. The bore of the ring 27 is so chosen that the rod 34 is freely slidable therein. In the front part, the guiding and maintaining means 35 guide a return spring 38 which acts on the knob 3. Note that the spring 34 is so stressed as to exert a force greater than the force exerted by the spring 38. Force values of 1.1 kg and 0.3 kg respectively for the springs 34 and 38 are preferred.

The operating knob 3 comprises a body of moulded plastics material which straddles the branches 8*a* and 8*b* so as to be slidable on the support in opposition to the action of the spring 38. This knob 3 has on each side projections 39 which define, on one hand, fixing lugs 40 which extend rearwardly and, on the other hand, cavities 41 which are located above the respective front ends of the lugs 40. The latter define on the inner side thereof grooves 42 which are adapted to be engaged on the corresponding end portions of the pin 29 which extend beyond the branches 8*a* and 8*b*. The cavities 41 are adapted to cap the slide portions 33 in the parts thereof which also extend beyond the branches 8*a* and 8*b*. The knob 3 is held in position by the lugs 40 which bear against the retaining tabs 21 which extend laterally outwardly from the rear portions of the branches 8*a*, 8*b*. A pin 43 extends inwardly from the inner side of the front wall 44 of the knob 3. The spring 38 is engaged on this pin.

The tab 24 of the locking means 22 defines a first abutment surface 45 against which the latch P is retained when the buckle is in the locking position thereof (see FIG. 1). The bearing tabs 23 define two second abutment surfaces 46 which bear against the stop means 30, i.e. against the slide portions 33 which extend from the centre body 32 of the stop means. The locking means also comprise a third abutment surface 47 defined by the front side of the tab 24 and adapted to cooperate with a complementary bearing surface 48 defined by the front edge of the longitudinal aperture 11 formed in the web 8 of the support 7.

The end portions of the collars 28 define thrust surfaces with which the rear edge 50 of the slide 13 is adapted to come in contact (see in particular FIG. 6) when the latch P is inserted in the buckle. Before describing the operation of the latter, the facility with which it may be assembled should be noted. Indeed, the buckle comprises four sub-assemblies consisting of:

the support provided with the slide 13 and the ejection spring 14;

the locking means 22 provided with the pin 29;

the stop means 30 provided with the springs 38 and 39, and the control knob 3.

When these four sub-assemblies have been assembled, the mechanism of the buckle is complete and ready to operate. It is then merely necessary to place this mechanism in the case 1 to form a complete buckle.

Note also that the locking means do not extend throughout the width of the support 7, apart from the dimension in the region of the bearing tabs 25 which corresponds (apart from clearance) to the distance between the branches 8*a* and 8*b*.

The buckle just described operates in the following manner:

FIG. 1 shows the configuration of the buckle in the closed position thereof. The latch P is engaged therein and is locked by the locking means 22 whose abutment surface 45 is in contact with an edge of the aperture of the latch P. The know 3 is in the position of rest to which it is biased by the action of the spring 38.

Figure 3:
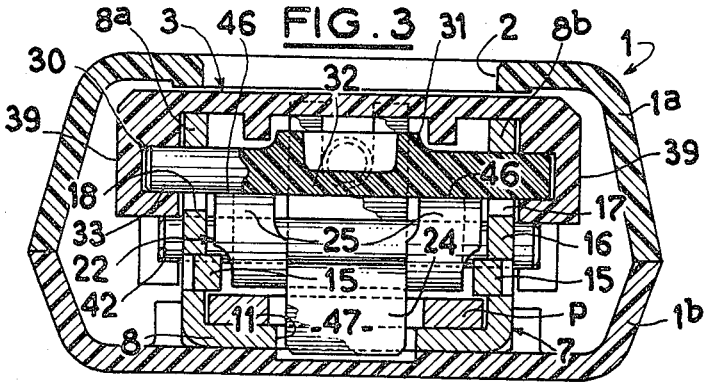
FIG. 3 is a sectional view taken on line 3—3 of FIG. 1.

It will be observed that, when a great tensile force is exerted on the latch by the belt in the direction for extracting the latch (arrow F), the locking means may slightly move in this direction until the surface 47 bears against the surface 48 of the support. However, the locking means are maintained laterally between the branches 8*a* and 8*b* by the tabs 25 whose overall dimension corresponds to the distance between these branches (FIG. 3). Under these conditions, which correspond to an impact on the passenger retained by the belt, the locking means are therefor retained not only in the region of the pin 29, but also in the region of the tab 24 which is under shear stress. The clearance or gap between the surfaces 47 and 48 can be taken up owing to the fact that the pin 29 can be elastically deformed, the points of application of the force (collars 28) being spaced a certain distance from the "bearings" (notches 20) of this pin. The threshold value beyond which the tensile force exerted on the buckle can take up the aforementioned clearance may be for example 50 kg.

By way of example, the following materials are chosen for the pin 29 and the locking means 22 in order to achieve an elastic deformation allowing the operation just described:

In respect of the pin 29, a steel of the type FM66 which has been hardened and tempered so as to have a strength of 120 to 150 daN/mm$^2$.

In respect of the locking means 22, a steel of the type M55-1 which has been subjected to the same heat treatment.

Figure 4:
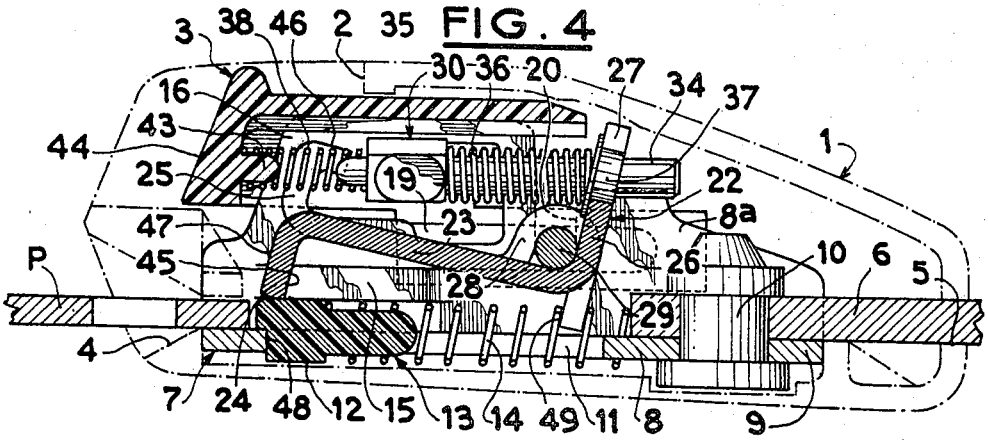
FIGS. 4 to 6 are views similar to FIG. 1 corresponding to other configurations of the buckle in the course of its operation.
Figure 5:
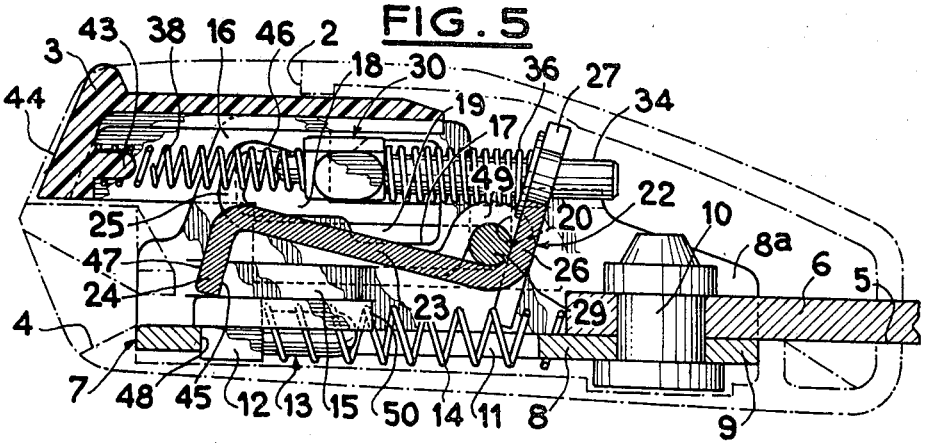

When opening the buckle, the knob 3 is urged rearwardy and the stop means move in the same direction in opposition to the action of the spring 36 and are disengaged from the abutment surfaces 46. The latch P is then released by the ejection spring 14 which urges the slide 13 forwardly, a tilting moment being applied to the locking means 22. The buckle is then in the position shown in FIG. 4 and then that shown in FIG. 5.

Figure 6:
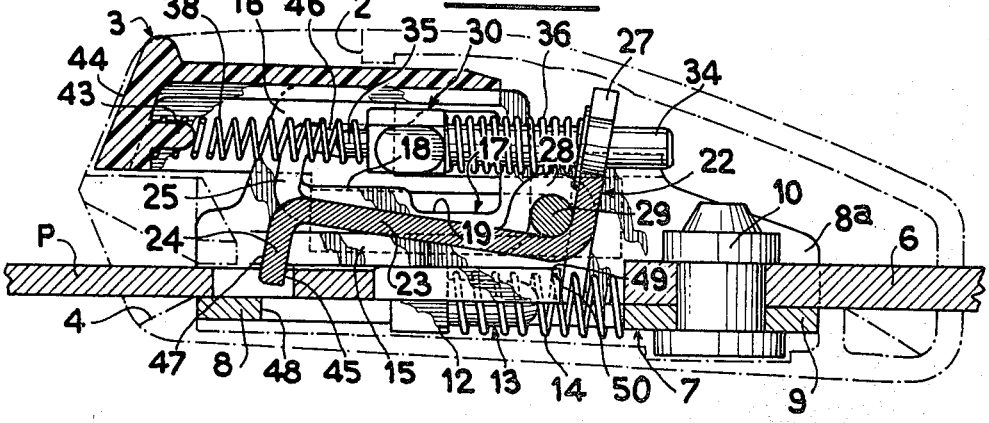
Figure 7:
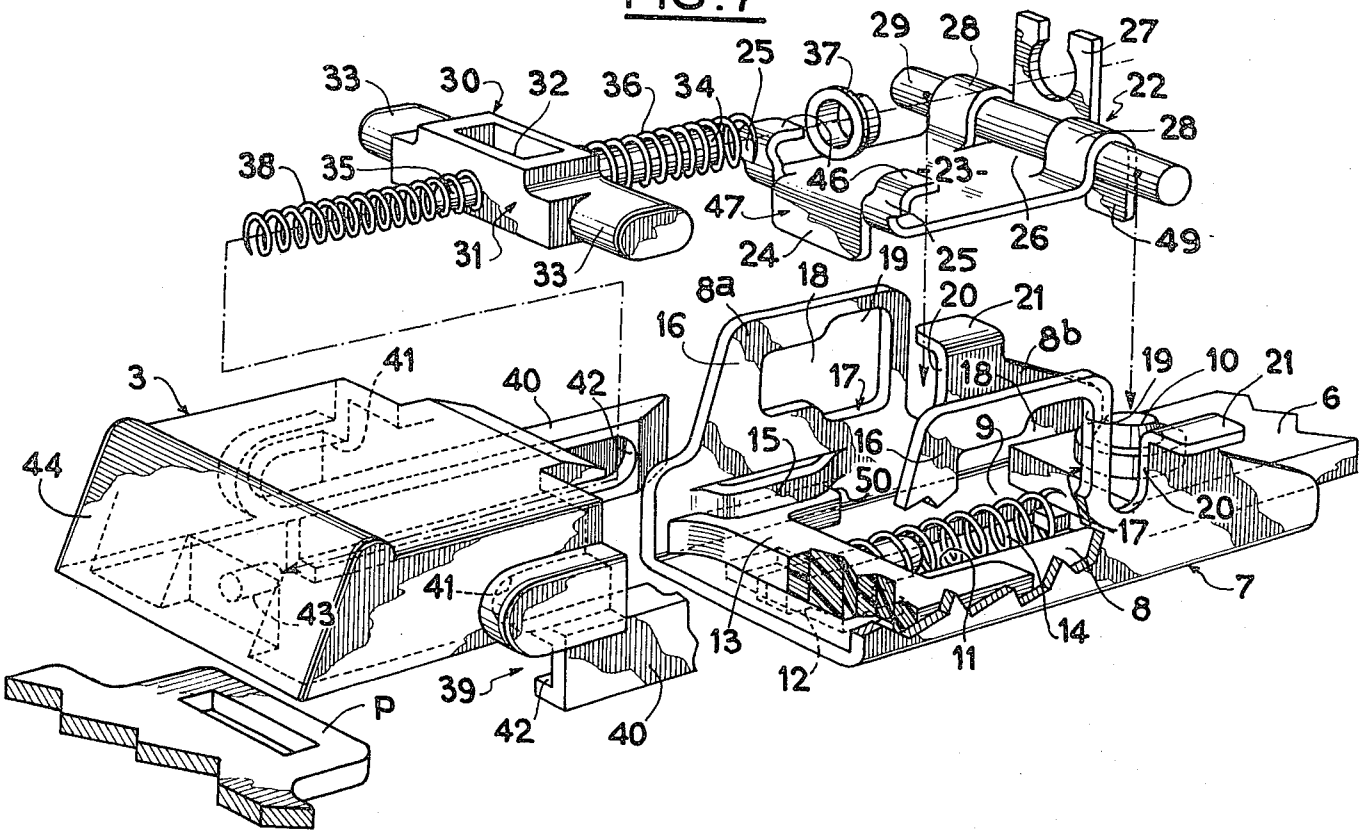
FIG. 7 is an exploded perspective view of the buckle according to the invention.

FIG. 6 represents the buckle just before the locking. The knob 3 remains in its position of rest, and the insertion of the latch P shifts the slide 13 rearwardly and the rear edge 50 of the latter comes in contact with the thrust surfaces 49 formed by the collars 28. The locking means thus tilt toward the locking position. At the end of this tilting movement, the stop means 30 is able to slide forwardly and place itself above the abutment surfaces 46 to which position the stop means are urged by the spring 36.

In order to facilitate the mounting of the stop means in the support, the branches 8*a* and 8*b* of the latter have openings 17 which are much larger than would be strictly necessary for guiding the stop means 30. Each opening 17 has a narrow part 18 and a wide part 19. The latter enables the stop means, provided with the two springs therefor, to be placed in position in the support. For this purpose, the slide portions 33 of the stop means are presented obliquely in the parts 19 and are then inserted by a tipping movement in the narrow parts 18 of the opening 17.

This operation may then be followed by the mounting of the locking means 22 whose eye member 27 is first engaged on the rod 34 after which the pin 29 is placed in the notches 20. The assembly is completed thereafter by placing in position the knob 3 whose lugs 40 are elastically clipped on the end portions of the pin 29 while being maintained by the tabs 21 of the support 7.

Note that in the assembled configuration of the buckle, the stop means 30 are only guided by the upper edge of the front portion 18 of the opening 17, these stop means being maintained in height by the springs 36 and 38 and by the cavities 41 of the knob 3.

Having now described my invention what I claim as new and desire to secure by Letters Patent is:

1. In a safety belt buckle for attaching a portion of a safety belt to retaining means by means of a tongue member forming a latch which is fixed to said portion of the safety belt to be attached, said buckle comprising a support for fixing to the retaining means and defining a rectilinear passage in which the latch may be inserted and which defines a sliding plane for the latch, locking means for locking the latch which are mounted on the support to pivot about an axis which extends in a direction parallel to the plane of the passage and which define at least a first abutment surface for retaining the latch and extending in a direction perpendicular to the plane of the passage and transversely in the passage in a locked position of the buckle, stop means, means for mounting the stop means on the support so that the stop means are movable in translation in the support in a direction perpendicular to said pivot axis of the locking means, the stop means being cooperative with the locking means for stopping the locking means from releasing the latch in one position of the stop means and releasing the locking means in another position of the stop means when opening the buckle, the locking means defining at least a second abutment surface for coming in contact with the stop means in said locked position of the buckle, an operating knob for opening the buckle and mounted relative to the support so as to be movable in the same direction as the stop means, the buckle further comprising return springs for respectively acting on the stop means and the locking means and the operating knob; the improvement wherein said stop means comprise a body which is in a single piece and defines guiding and maintaining means for said springs, said guiding and maintaining means extending from opposite sides of said body in a direction perpendicular to said pivot axis of the locking means, and said means for mounting the stop means on the support comprise two opposed slide portions of said body which extend in directions transverse to said direction in which the stop means are movable in the support, and two opposed openings defined by the support, into which openings said slide portions respectively extend, each of said openings having a first part for guidingly engaging said slide portions in operation of the buckle and a second part for allowing engagement of said slide portions in said openings when initially assembling the buckle.

2. A buckle according to claim 1, wherein said second part of said openings is smaller than said first part thereof, so that said slide portions can be inserted in the respective first part of said openings by tilting the stop means, after which the slide portions can be shifted into said second part of said openings for the guiding of said slide portions by the respective small part of the openings.

3. A buckle according to claim 1, wherein the support has two lateral branches respectively defining two upwardly open notches, and the locking means comprise a pin coaxial with said axis extending in a direction parallel to the plane of said passage and means for receiving and holding said pin, said pin being engageable in said notches upon assembly of the locking means with the support, the two branches of the support also comprising two opposed retaining tabs and the knob comprising two lugs which define two opposed slots engageable on opposed end portions of said pin upon assembly of the knob with the support and said locking means, said two opposed tabs being engageable with upper surfaces of said two lugs for retaining said pin in said notches when the buckle is assembled.

4. A buckle according to claim 1, wherein the stop means are made from a moulded plastics material.

5. A buckle according to claim 4, comprising a fibre glass filler in said moulded plastics material.

6. A buckle according to claim 1, 4 or 5, wherein one of said guiding and maintaining means comprises a rod which extends between said body of the stop means and a guiding portion formed on the locking means in which said guiding portion said rod is freely slidable in the course of the opening and closing of the buckle.

7. A buckle according to any one of the claim 1, 4 or 5, wherein one of said guiding and maintaining means comprises a lug which is disposed in facing relation to a corresponding lug formed inside the operating knob.

8. A buckle according to claim 1, 4 or 5, wherein the support has lateral branches, and articulation means pivotally mount the locking means in the support, said articulation means being mounted in said lateral branches, lateral projections on said lateral branches defining said rectilinear passage and extending to a great extent in a direction parallel to the plane of the passage.

9. A buckle according to claim 1, 4 or 5, wherein articulation means pivotally mount the locking means in lateral branches of the support, said articulation means projecting from opposite sides of the locking means between the locking means and the lateral branches of the support so as to permit an elastic deformation of the articulation means when a tensile force exceeding a threshold value is exerted on the latch.

10. A buckle according to claim 9, wherein said articulation means comprise a pivot pin.

* * * * *